United States Patent [19]

Hoobery

[11] 4,001,969

[45] Jan. 11, 1977

[54] GARAGE DOOR STRUCTURE

[76] Inventor: Joseph J. Hoobery, 8908 W. 104th St. Drive, Overland Park, Kans. 66212

[22] Filed: July 6, 1976

[21] Appl. No.: 702,735

[52] U.S. Cl. ..... 49/95; 160/113; 160/189

[51] Int. Cl.[2] ..... E05F 17/00

[58] Field of Search ..... 49/95, 96, 97, 73; 160/113, 189, 188

[56] References Cited

UNITED STATES PATENTS

| | | | |
|---|---|---|---|
| 1,054,417 | 2/1913 | Hutchinson | 49/95 x |
| 2,112,347 | 3/1938 | Ross | 49/95 X |
| 2,851,266 | 9/1958 | Klamp | 160/189 |
| 3,240,484 | 3/1966 | Klamp | 160/189 |

*Primary Examiner*—Philip C. Kannan
*Attorney, Agent, or Firm*—Fishburn, Gold & Litman

[57] ABSTRACT

A garage door structure includes a pair of doors each movable between a closed position and an open position for the side-by-side door openings. The garage door structure includes components for moving the doors together as a unit between the open position and the closed position. The doors are tied together as a unit by an upper tie member and a lower tie member each extending between and having opposite end portions thereof each connected to a side edge portion of a respective one of the doors. A remote controlled power device or operator is operatively connected to the upper tie member for selectively and simultaneously moving the doors between the open position and the closed position.

7 Claims, 6 Drawing Figures

Fig. 4.
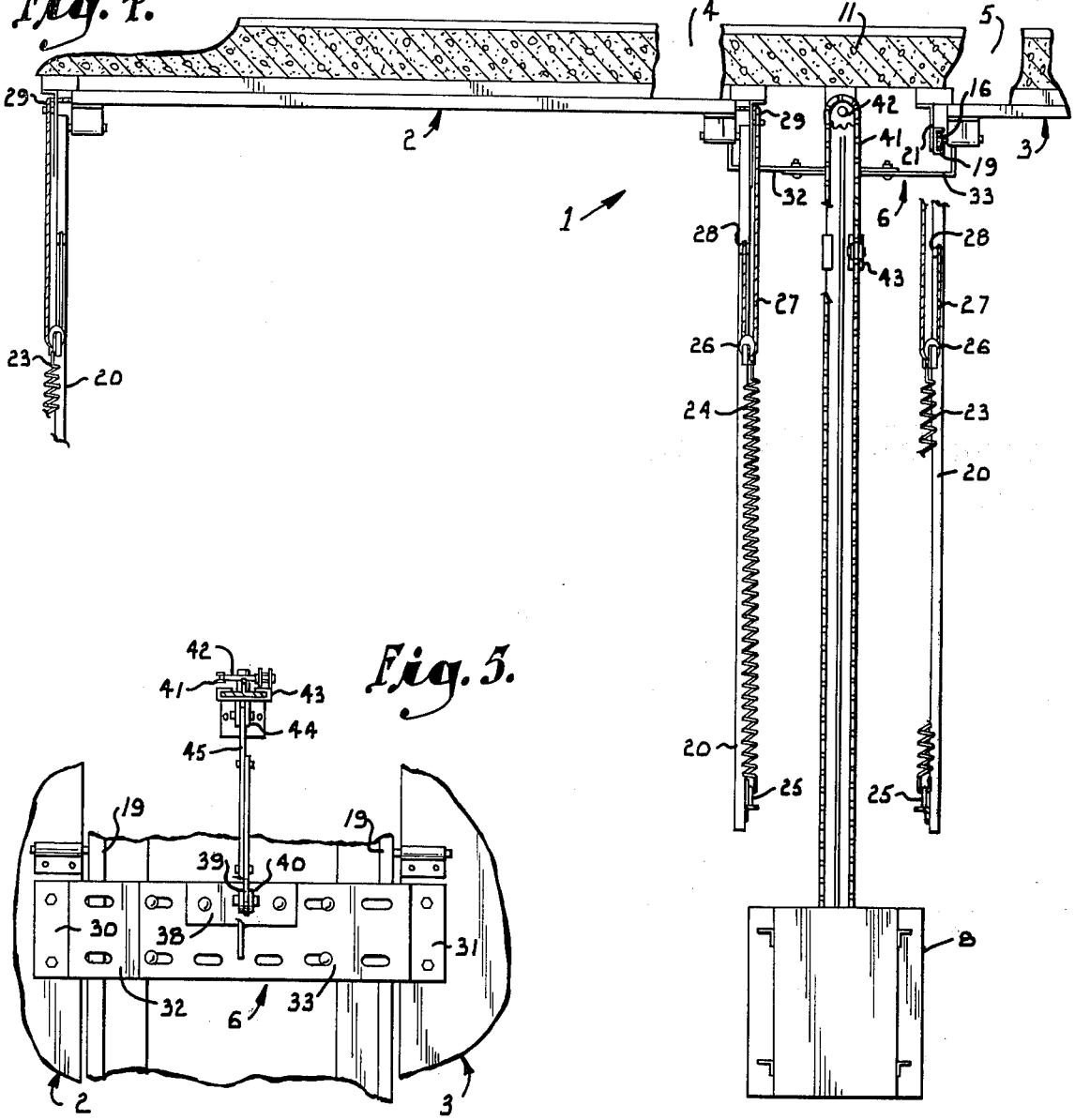
Fig. 5.
Fig. 6.
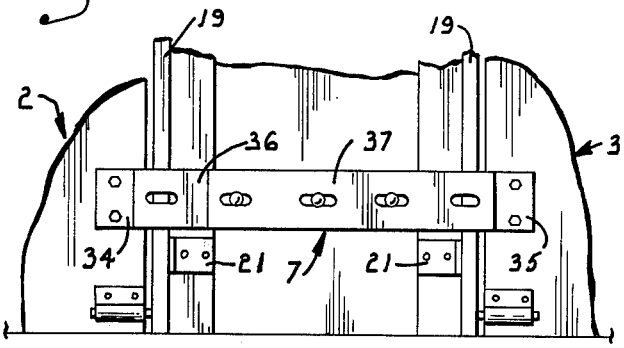

GARAGE DOOR STRUCTURE

The present invention relates to garage door structures and more particularly to a garage door structure having means for moving two doors together as a unit between a closed position and an open position.

The principal objects of the present invention are: to provide a garage door structure including means for moving a pair of side-by-side doors together as a unit between a closed position and an open position for a respective pair of side-by-side door openings; to provide such a garage door structure including upper and lower tie members each extending between and having opposite end portions thereof connected to the pair of doors for movement together as a unit; to provide such a garage door structure wherein the upper and lower tie members each include an adjustable body portion adapted to conform to the spacing or width of a post member between the side-by-side door openings; to provide such a garage door structure including one remote controlled powered operation operatively connected to the upper tie member for selectively and simultaneously moving the pair of doors between the closed position and the open position; and to provide such a garage door structure wherein the components are economical to manufacture, easy to install, durable in construction, positive in operation and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include an exemplary embodiment of the present invention and illustrate various objects and features of the garage door structure.

FIG. 4 is a top plan view of the garage door structure.

FIG. 5 is an enlarged front elevational view of an upper tie member extending between the pair of doors.

FIG. 6 is an enlarged front elevational view of a lower tie member extending between the pair of doors.

Figure 1:
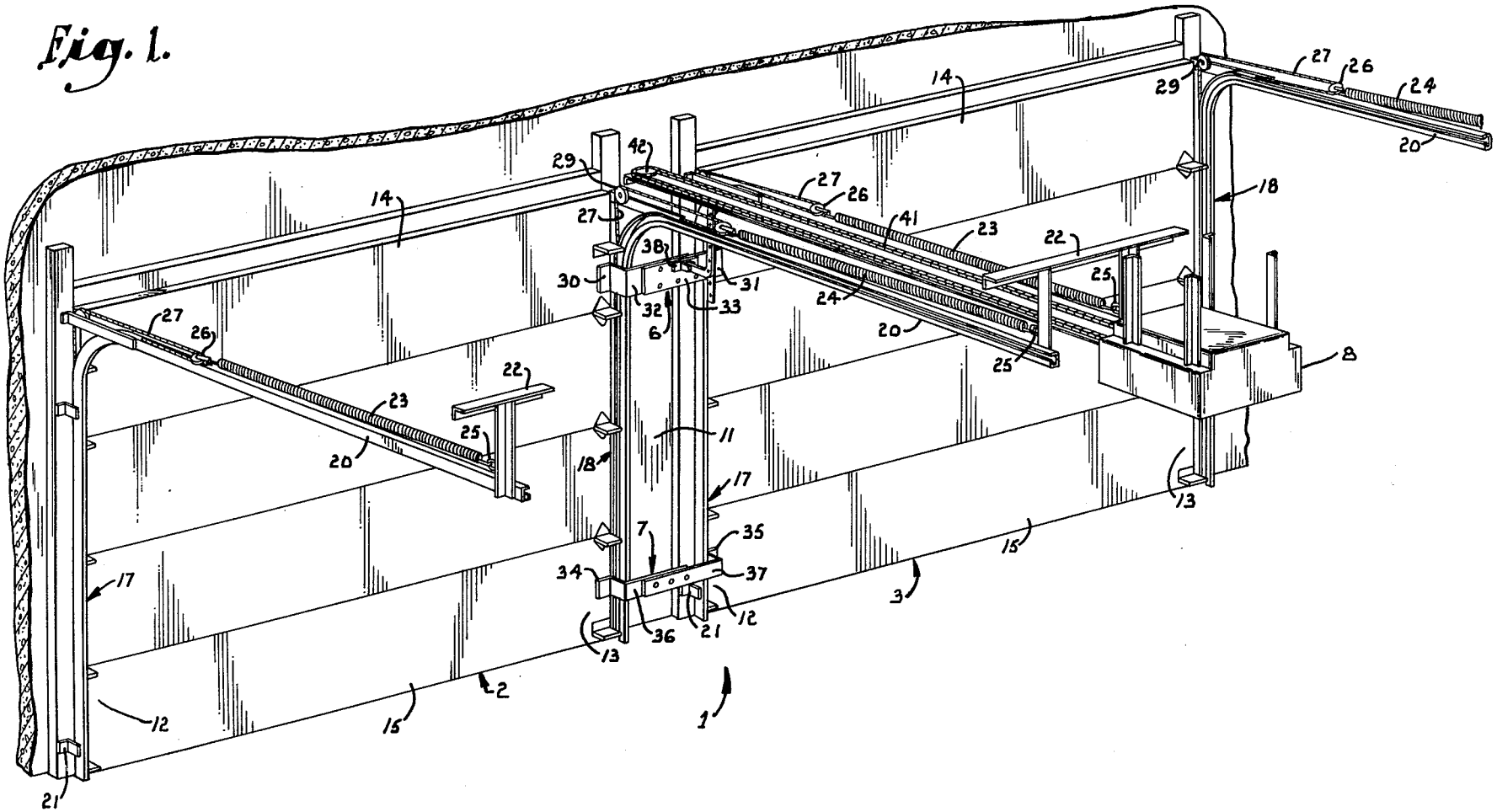
FIG. 1 is a perspective view of the garage door structure embodying features of the present invention and showing components for moving a pair of doors together as a unit between an open position and a closed position.
Figure 2:
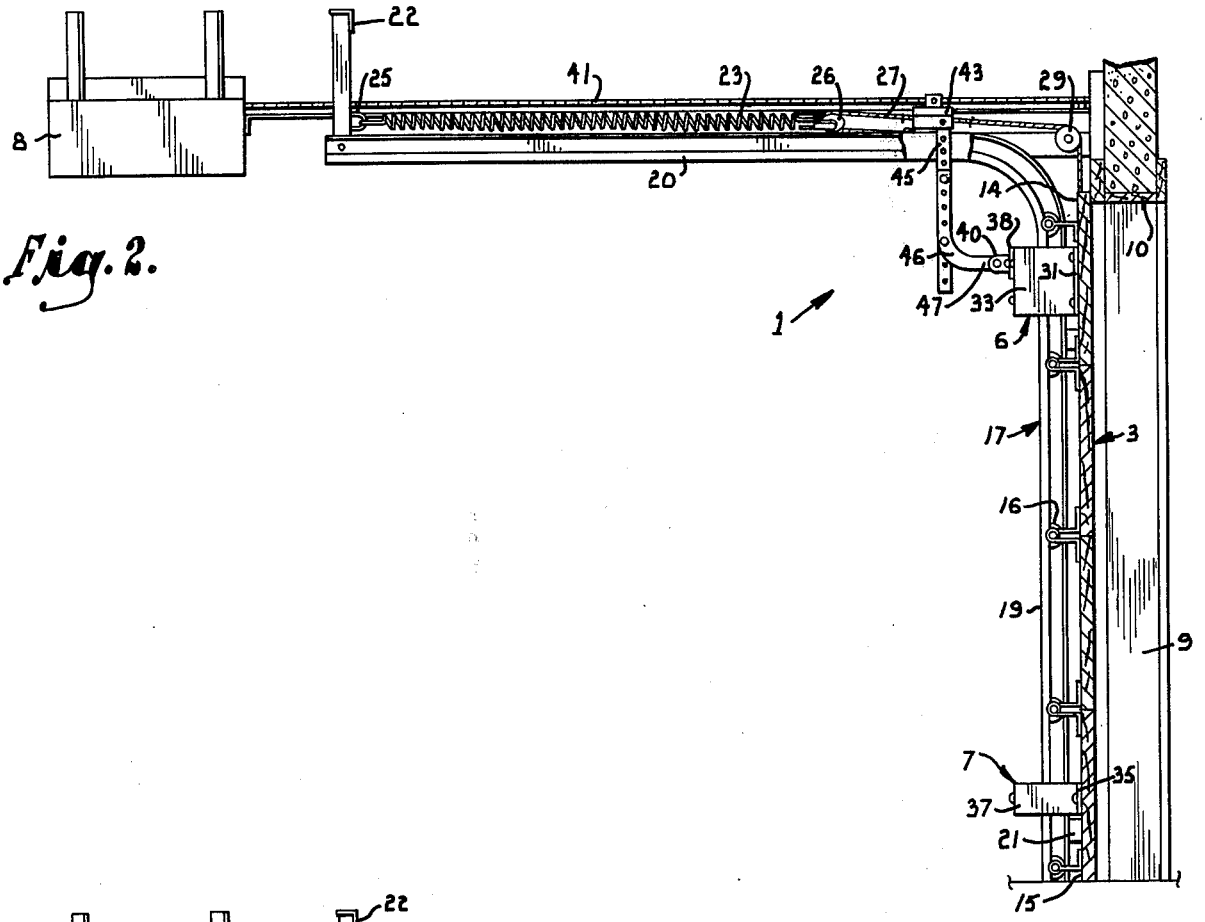
FIG. 2 is a side elevational view of one of the pair of doors shown in the closed position.
Figure 3:
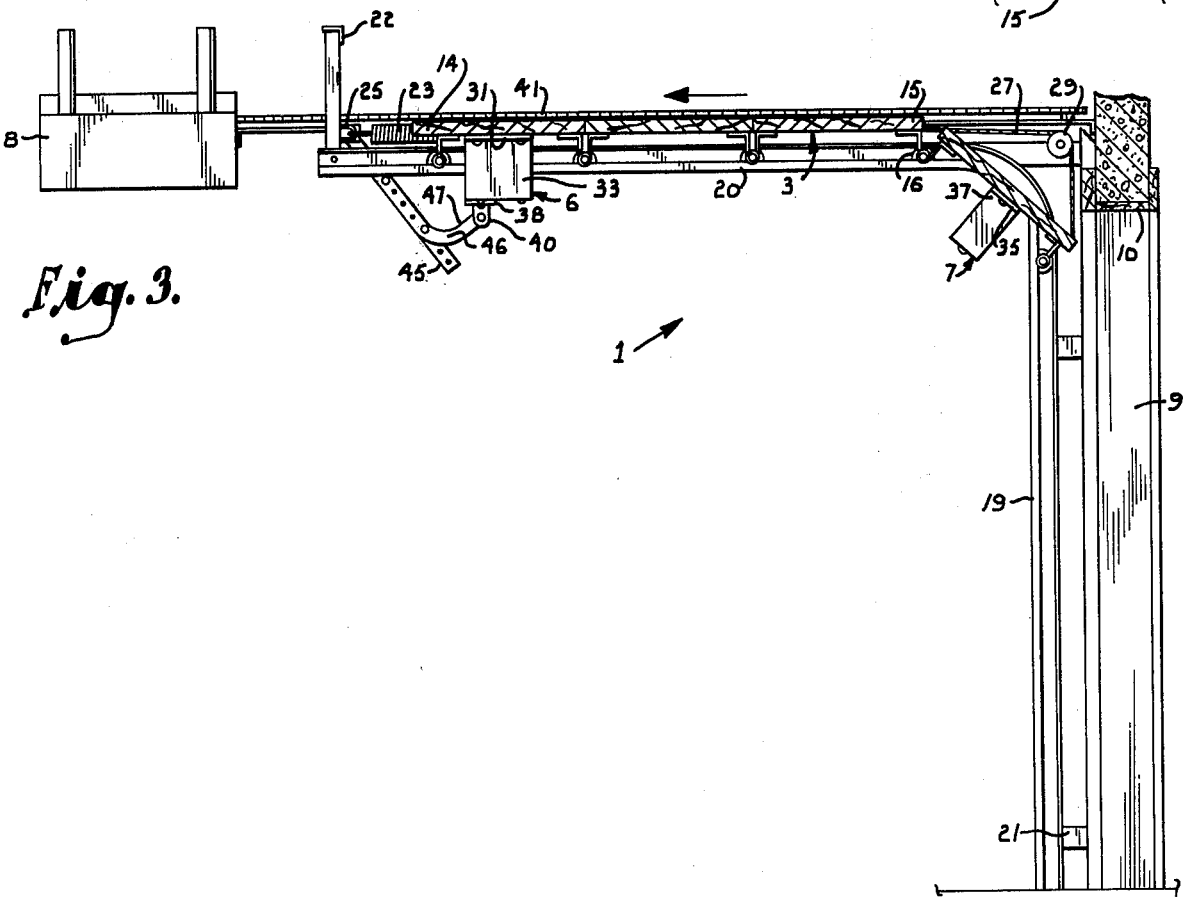
FIG. 3 is a side elevational view of one of the pair of doors shown in the open position.

As required, detailed embodiments are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

Referring more in detail to the drawings:

In the disclosed embodiment of the present invention, the reference numeral 1 generally designates a garage door structure which includes doors 2 and 3 each movable between a closed position and an open position for respective side-by-side door openings 4 and 5. The garage door structure 1 includes components for moving the doors 2 and 3 together as a unit between the open position and the closed position. The doors 2 and 3 are tied together as a unit by an upper tie member 6 and a lower tie member 7 each extending between and having opposite end portions thereof each connected to a side edge portion of a respective one of the doors 2 and 3. A remote controlled powered device or operator 8 is operatively connected to the upper tie member 6 for selectively and simultaneously moving the doors 2 and 3 together as a unit between the closed position and the open position.

The structure defining each of the door openings 4 and 5 includes laterally spaced jamb members 9 with a top member 10 extending therebetween. A post member or other separator 11 is positioned between the door openings 4 and 5 with the width of such member 11 being determined by the structural and architectural design considerations of the respective structure. The jamb members 9, the top member 10, and the post member 11 each have an exterior surface and an interior surface with the doors 2 and 3 being in facing relation with the interior surface of the respective jamb members 9 and the top member 10.

The doors 2 and 3 may be any conventional garage door that is suitable for operation by a powered operator with each having opposite side edge portions 12 and 13 and top and bottom edge portions 14 and 15. The doors 2 and 3 in the illustrated structure are sectional with each door having a plurality of rollers 16 on each of the side edge portions 12 and 13 thereof with at least one roller on each section with said rollers 16 being received in and movable along respective guide tracks 17 and 18 whereby the sectional doors 2 and 3 generally follow the container of the tracks.

Each of the guide tracks 17 and 18 for each of the doors 2 and 3 has a lower generally upright portion 19 adapted to position the respective door in a closed position. The guide tracks 17 and 18 each have an upper generally level portion 20 positioned above and connected to the upright portion 19 and adapted to position the respective door in an open condition, as is conventional. In the illustrated embodiment, one guide track 18 for the door 2 and one guide track 17 for the door 3 are mounted on the post member 11.

The guide tracks 17 and 18 for each of the doors 2 and 3 are each suitably held in position by one or more lower brackets 21 positioned adjacent and connected to the upright portion 19 of the respective guide tracks 17 and 18 and to the respective adjacent jamb members 9. An upper bracket 22 is positioned adjacent one end of the upper portion 20 of each of the guide tracks 17 and 18 to retain same in a fixed position. The brackets 21 and 22 are each suitably mounted on the structure of the building, house, or the like. In the illustrated embodiment, the lower brackets 21 are mounted on the respective jamb member in vertical spaced relation and each of the upper or end brackets 22 are mounted on and depend from a suitable structural member in the ceiling of the building.

Each of the garage doors 2 and 3 has suitable counter-balances of conventional type. In the illustrated structure, the doors have resilient means with one end fixed relative to a respective one of the guide tracks 17 and 18 and the other end of the resilient means connected through cables and pulleys to a lower portion of a respective one of the respective doors 2 and 3.

Each of the garage doors 2 and 3 may have a single elongated spring or a pair of elongated springs 23 and 24 adjacent the upper or level portion 20 of each of the guide tracks 17 and 18. In the illustrated embodiments, the springs 23 and 24 are each coil springs and each is positioned substantially parallel with the upper generally level portion 20 of the guide tracks 17 and 18. One end of each of the springs 23 and 24 is fixably mounted on a respective one of the upper brackets 22 in any suitable manner, such as by having a hook portion thereof extending through a U-bolt 25 mounted on the upper bracket 22. The other end of each of the elongated springs 23 and 24 is connected to a pulley having a flexible member 27 received therein and having one end connected to the respective door.

The flexible member 27 has the other end thereof connected to a suitable bracket 28 secured on the structure of the building, house, or the like in any suitable manner. The flexible member 27 extends from the bracket 28 and around the pulley 26 on the other end of a respective one of the springs 23 and 24 and around a direction changing pulley 29 mounted on the structure of the building, house, or the like, as by being rotatably supported on a suitable bracket. The flexible member 27 has the one end thereof connected to the respective door adjacent the bottom edge portion 15 thereof whereby the elongated coil springs 23 and 24 urge the respective doors 2 and 3 toward the open position after partial opening movement.

The improvement of the present invention includes providing means for moving the doors 2 and 3 together as a unit between a closed position and an open position. The illustrated means includes the lower tie member 7, the upper tie member 6, the remote controlled power operator 8, and the connection between the operator 8 and the upper tie member 6.

In the illustrated embodiment, the upper tie member 6 extends between and has opposite end portions 30 and 31 thereof connected to the doors 2 and 3 and the end portions 30 and 31 are positioned adjacent the top edge portion 14 of the doors 2 and 3. The upper tie member 6 includes a body portion extending between the opposite end portions 30 and 31 thereof. The body portion of the upper tie member 6 is in spaced relation with the interior surface of the post member 11 and one guide track for each of the doors 2 and 3 is positioned between the doors 2 and 3 and the body portion of the upper tie member 6.

The body portion of the upper tie member 6 includes a first portion 32 and a second portion 33 extending from the end portions 30 and 31 respectively. The first and second portions 32 and 33 of the body portion of the upper tie member 6 include means for securing together the first and second portions 32 and 33 with a selected spacing between the end portions 30 and 31 whereby the upper tie member 6 is adjustable to conform to the width of the post member 11 between the door openings 4 and 5.

In the illustrated embodiment, the first and second body portions 32 and 33 of the upper tie member 6 each have at least one and preferably a plurality of rows of longitudinally spaced elongated slots therein. The first and second body portions 32 and 33 of the upper tie member 6 are adapted to be positioned in engagement one with the other and with the row or rows of elongated slots in alignment. When the body portions 32 and 33 have been adjusted to effect the desired spacing between the end portions 30 and 31, suitable fastening devices, such as a plurality of bolts and nuts, extend through selected aligned slots in the first and second body portions 32 and 33 and are tightened to secure same in the selected position.

The illustrated lower tie member 7 extends between and has opposite end portions 34 and 35 connected to the doors 2 and 3 and the end portions 34 and 35 are positioned adjacent the bottom edge portion 15 of the doors 2 and 3. The lower tie member 7 includes a body portion extending between the opposite end portions 34 and 35 thereof. The body portion of the lower tie member 7 is in spaced relation with the interior surface of the post member 11 and one guide track for each of the doors 2 and 3 is positioned between the doors 2 and 3 in the body portion of the lower tie member 7.

The body portion of the lower tie member 7 includes a first portion 36 and a second portion 37 extending from the end portions 34 and 35 respectively. The first and second portions 36 and 37 of the body portion of the lower tie member 7 include means for securing together the first and second portions 36 and 37 with a selected spacing between the end portions 34 and 35 whereby the lower tie member 7 is adjustable to conform to the width of the post member 11 between the door openings 4 and 5.

In the illustrated embodiment, the first and second body portions 36 and 37 of the lower tie member 7 each have at least one row of a plurality of longitudinally spaced elongated slots therein. The first and second body portions 36 and 37 of the lower tie member 7 are adapted to be positioned in engagement one with the other and with the respective row or rows of slots in alignment. When the body portions 36 and 37 have been adjusted to effect the desired spacing between the end portions 34 and 35 of the lower tie member 7, suitable fastening devices, such as a plurality of bolts and nuts, extend through the selected aligned slots in the first and second portions 36 and 37 and are tightened to secure same in the selected position.

A bracket 38 is mounted on the body portion of the upper tie member 6 and provides means for connection of the power operator 8 to the upper tie member 6. The illustrated bracket 38 includes a generally planar member or portion suitably secured to the body portion of the upper tie member 6, as by suitable fastening devices, such as nuts and bolts or screws. The bracket 38 includes a pair of laterally spaced ears 39 and 40 extending from the planar portion of the bracket 38, for a purpose later described.

The remote controlled power means or operator 8 is operatively connected to the bracket 38 mounted on the body portion of the upper tie member 6 for selectively and simultaneously moving the doors 2 and 3 as a unit between the closed position and the open position. The power operator 8 includes a suitable reversible, electric drive motor (not shown) operative to drive an endless member 41, such as a chain, around a suitable direction changing member 42, such as a sprocket, suitably supported on the structure of the building, house, or the like. The power operator 8 includes a movable member 43 in engagement with the endless member 41.

The movable member 43 includes a body portion having a rib 44 depending therefrom. An arm 45 has one end portion thereof pivotally mounted on the rib 44 of the movable member 43 and extends therefrom. The arm 45 is an elongated member having a projection 46 extending therefrom and having a free end portion 47 of the projection 46 adapted to be positioned between and pivotally mounted on the ears 39 and 40 of the bracket 38 mounted on the body portion of the upper tie member 6. It is preferable that the projection 46 be adjustably mounted on the arm 45 so that the free end portion 47 of the projection 46 is between and aligns with the ears 39 and 40 of the bracket 38 for pivotal mounting thereon.

In constructing and using a garage door structure, as illustrated and described, the building structure is completed and the jamb members 9 and the top member 10 for each of the door openings 4 and 5 are secured to the respective wall and post member 11. The guide tracks 17 and 18 for each door opening are mounted on the lower brackets 21 and the respective upper bracket 22. The doors 2 and 3 are mounted for movement along their respective tracks 17 and 18. The doors 2 and 3 are suitably counterbalanced, as by the springs 23 and 24 and a flexible member 27 for each of the springs 23 and 24.

The upper and lower tie members 6 and 7 are mounted on the doors 2 and 3 by securing the end portions thereof to the respective side edge portions of the doors 2 and 3 adjacent the post member 11. The power operator 8 is supported on a suitable bracket or the like, depending from the ceiling of the structure of the building, house, or the like. The movable member 43 is positioned adjacent one end of the travel thereof. The projection 46 is adjusted relative to the bracket 38 on the upper tie member 6 and mounted on the arm 45 extending from the movable member 43. Movement of the movable member 43 by the power operator 8 thereby selectively and simultaneously moves the doors 2 and 3 between the open and closed position.

It is to be understood that while I have illustrated and described one form of my invention, it is not to be limited to the specific form or arrangement of parts herein described and shown.

What I claim and desire to secure by Letters Patent is:

1. In a garage door structure having a pair of side-by-side door openings and a pair of doors movable between a closed position and an open position, each of said doors having a pair of guide tracks each positioned adjacent respective opposite sides of the respective door opening, each of said doors being counterbalanced and having means thereon guided in said respective guide tracks for movement of said doors between a closed position and an open position, the garage door structure having means for moving said pair of doors together as a unit between the closed position and the open position and comprising:

a. an upper tie member extending between and having opposite end portions thereof connected to a pair of doors adjacent an upper portion of said doors;

b. a lower tie member extending between and having opposite end portions thereof connected to said pair of doors adjacent a lower portion of said doors; and c. a remote controlled power means operatively connected to said upper tie member for selectively and simultaneously moving said pair of doors together as a unit between the closed position and the open position.

2. A garage door structure as set forth in claim 1 wherein:

a. said upper tie member includes a body portion extending between the opposite end portions thereof and with a guide track for each of said doors positioned between said upper tie member body portion and said respective doors; and b. said lower tie member includes a body portion extending between the opposite end portions thereof and with a guide track for each of said doors positioned between said lower tie member body portion and said respective doors.

3. In a garage door structure as set forth in claim 2 wherein:

a. said power means includes a movable portion having an arm extending therefrom;

b. said arm of said power means includes a projection extending therefrom and having a free end; and c. said body portion of said upper tie member includes a bracket extending outwardly therefrom and having said projection of said arm of said power means pivotally mounted thereon.

4. In a garage door structure as set forth in claim 2 wherein:

a. said body portion of said upper tie member includes a first portion and a second portion each extending from a respective one of the opposite end portions thereof;

b. said body portion of said upper tie member includes means for securing together said first portion and said second portion thereof with a selected spacing between the opposite end portions of said upper tie member whereby said upper tie member is adjustable;

c. said body portion of said lower tie member includes a first portion and a second portion each extending from a respective one of the opposite end portions thereof; and d. said body portion of said lower tie member includes means for securing together said first portion and said second portion thereof with a selected spacing between the opposite end portions of said lower tie member whereby said lower tie member is adjustable.

5. In a garage door structure as set forth in claim 1 wherein said pair of side-by-side door openings include a post member therebetween and said pair of doors each include opposite side portions each in covering relation with a respective one of the sides of the respective door opening and wherein:

a. the upper tie member opposite end portions are each mounted on a respective side portion of the respective door;

b. the lower tie member opposite end portions are each mounted on a respective side portion of the respective door;

c. said upper tie member includes a body portion extending between the opposite end portions thereof and with a guide track for each of said doors positioned between said upper tie member body portion and a post member between said door openings; and d. said lower tie member includes a body portion extending between the opposite end portions thereof and with a guide track for each of said doors positioned between said lower tie member body portion and a post member between said door openings.

6. In a garage door structure as set forth in claim 5 wherein:

a. said power means includes a movable portion having an arm extending therefrom;

b. said arm of said power means includes a projection extending from said arm and having a free end; and c. said body portion of said upper tie member includes a bracket extending outwardly therefrom and having said projection of said arm of said power means pivotally mounted thereon.

7. In a garage door structure as set forth in claim 5 wherein:

a. said body portion of said upper tie member includes a first portion and a second portion each extending from a respective one of the opposite end portions thereof;

b. said body portion of said upper tie member includes means for securing together said first portion and said second portion of said upper tie member body portion with a selected spacing between the opposite end portions of said upper tie member whereby said upper tie member is adjustable to conform to the width of the post member between said door openings;

c. said body portion of said lower tie member includes a first portion and a second portion each extending from a respective one of the opposite end portions thereof; and d. said body portion of said lower tie member includes means for securing together said first portion and said second portion of said lower tie member body portion with a selected spacing between the opposite end portions of said lower tie member whereby said lower tie member is adjustable to conform to the width of the post member between said door openings.

* * * * *